US007484312B2

(12) United States Patent
Morgan

(10) Patent No.: US 7,484,312 B2
(45) Date of Patent: Feb. 3, 2009

(54) PUNCH PRESS ALIGNMENT INSTRUMENT

(75) Inventor: Christopher D. Morgan, Minneapolis, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 129 days.

(21) Appl. No.: 11/728,685

(22) Filed: Mar. 26, 2007

(65) Prior Publication Data

US 2007/0180723 A1 Aug. 9, 2007

Related U.S. Application Data

(63) Continuation-in-part of application No. 11/125,988, filed on May 9, 2005, now Pat. No. 7,194,820.

(51) Int. Cl.
*G01D 21/00* (2006.01)
*B23Q 3/00* (2006.01)
*B26F 1/14* (2006.01)

(52) U.S. Cl. ..... 33/645; 33/613; 33/627; 33/655; 29/465; 83/684; 72/481.1

(58) Field of Classification Search ..... 33/645, 33/613, 626–628, 655; 83/684–691; 29/465; 72/481.1, 481.3

See application file for complete search history.

(56) References Cited

U.S. PATENT DOCUMENTS 2,089,795 A 8/1937 Hodge
2,381,062 A 8/1945 Kirsch
3,126,776 A 3/1964 Whistler et al.
3,200,508 A 8/1965 Harper
3,273,168 A 9/1966 Gardner
3,342,091 A 9/1967 Schott
4,328,621 A 5/1982 Benjamin
4,386,532 A 6/1983 Benjamin
4,542,674 A 9/1985 Omo, Jr.

(Continued)

OTHER PUBLICATIONS

Mate Precision Tooling Inc. Thick Turret Line up Tools; Catalog Oct. 1, 2002 4 Pages Published by Mate Precision Tooling Inc. Anoka, Minnesota. U.S.

*Primary Examiner*—G. Bradley Bennett
*Assistant Examiner*—Amy Cohen Johnson
(74) *Attorney, Agent, or Firm*—Nikolai & Mersereau, P.A.; James V. Harmon

(57) ABSTRACT

A punch press alignment instrument has upper and lower cylindrical components that are associated for vertical displacement relative to one another. Both components have outer tool holder engaging surfaces which are to be aligned with one another so as to in turn align the tool holders of the punch press when the upper and lower components themselves are in alignment. Alignment elements, e.g., ridges and grooves provided on mating surfaces of the components confronting each other are brought into contact with one another to move the components of the instrument into mutual alignment. An alignment control member, e.g., a screw is preferably provided for progressively bringing the upper and lower components toward one another and an indicator such as a lamp, a dial indicator or an audible indicator is provided for denoting the spacing between the upper and lower components to thereby confirm the alignment of the tool holders. A releasable element is used to temporarily hold the upper and lower components apart when they are spaced laterally from one another or for any reason are not capable of being placed in alignment.

17 Claims, 10 Drawing Sheets

U.S. PATENT DOCUMENTS

| | | | | |
|---|---|---|---|---|
| 5,920,999 | A | 7/1999 | Hutter | |
| 6,301,763 | B1 | 10/2001 | Pryor | |
| 6,357,329 | B1 * | 3/2002 | Sakamoto et al. | 83/698.91 |
| 6,442,859 | B1 | 9/2002 | Hinzpeter et al. | |
| 6,772,667 | B2 | 8/2004 | Phlipot | |
| 6,813,843 | B1 | 11/2004 | Faubion | |
| 6,842,994 | B2 | 1/2005 | McInroy | |
| 7,194,820 | B2 * | 3/2007 | Schweiger et al. | 33/645 |

* cited by examiner

PUNCH PRESS ALIGNMENT INSTRUMENT

This application is a continuation in part of application Ser. No. 11/125,988 filed May 9, 2005 now U.S. Pat. No. 7,194,820 entitled PUNCH PRESS ALIGNMENT INSTRUMENT which is incorporated herein by reference and all of claims 1-17 herein find support under Rule 112 in the present application.

FIELD OF THE INVENTION

This invention relates to the punch and die art and more particularly to an alignment instrument for a punch press.

BACKGROUND OF THE INVENTION

In many standard punch presses, a punch element is carried on an upper turret in alignment over a die that is mounted on a lower turret. The punch and die are both held in circular tool holders. Before the press can be operated, the tool holders must be placed in vertical alignment with one another so that the punch and die are in turn in alignment during operation. An alignment tool previously used by the assignee of the present invention included upper and lower parts in which the upper part was provided with a pair of laterally spaced apart downwardly extending cylindrical pins that were placed in corresponding cylindrical openings in the lower part of the device to align the tool holders. The device was cumbersome to operate and there was no means of indicating when the upper and lower parts of the device were in alignment. Alignment tolerances were also not as good as are sometimes required. In addition, there was no device for progressively moving the upper and lower parts toward one another or for automatically bringing them into progressively better alignment with one another.

In some punch presses, because upper and lower turrets do not rotate on a common axis or for some other reason stations are out of alignment, the upper and lower parts of the alignment instrument should not contact one another while they are not able to be aligned.

In view of these and other deficiencies of the prior art, it is one object of the invention to enable upper and lower components of the alignment instrument to be placed into contact with one another only when they are in a position where they are capable of being aligned.

Another general object is to provide an improved alignment instrument that will align a punch and a die in three ways simultaneously; horizontally on perpendicular x and y axes with respect to the base of the punch press as well as automatically rotating the die with respect to the punch about a common vertical axis.

Another object of the invention is the provision of a device for moving upper and lower components of an alignment instrument apart or toward one another under the control of an operator for bringing them into alignment.

Yet another object of the invention is the prevision of an indicator that operates automatically to indicate the alignment of two components of the instrument which in turn align a punch holder with a cooperating die holder.

A still further object of the invention is the provision of an improved punch press alignment instrument having a visual display that will indicate both partial and complete alignment of components.

These and other more detailed and specific objects of the invention will be apparent in view of the following description and drawings which illustrate by way of example a few of the various ways the invention can be carried out within the scope of the appended claims.

SUMMARY OF THE INVENTION

Briefly, the instrument comprises first and second mating parts or components, preferably cylindrical in shape, that are associated for longitudinal displacement relative to one another. Both parts have outer tool holder engaging portions which are to be aligned with one another to align the tool holders of the punch press when the first and second parts are in alignment. Alignment elements that are provided on mating surfaces of the parts confronting each other are brought into contact with one another to move the first and second parts of the instrument into mutual alignment. An alignment control member, e.g., a screw, is provided for progressively bringing the parts toward one another and an indicator such as a lamp, a dial indicator or an audible indicator is provided for denoting the spacing between the first and second parts to thereby confirm the alignment of the tool holders. In one preferred form of the invention, the alignment instrument includes upper and lower cooperating components that are each cylindrical in shape and connected together for longitudinal displacement relative to one another on a vertical axis as well as for rotation about the vertical axis. The indicator may consist of a dial indicator or one or more colored lights to indicate correct alignment. A releasable element is used to temporarily hold the upper and lower components apart for example when they are spaced laterally from one another or for any other reason cannot be placed in alignment.

DETAILED DESCRIPTION OF THE INVENTION

Figure 1:
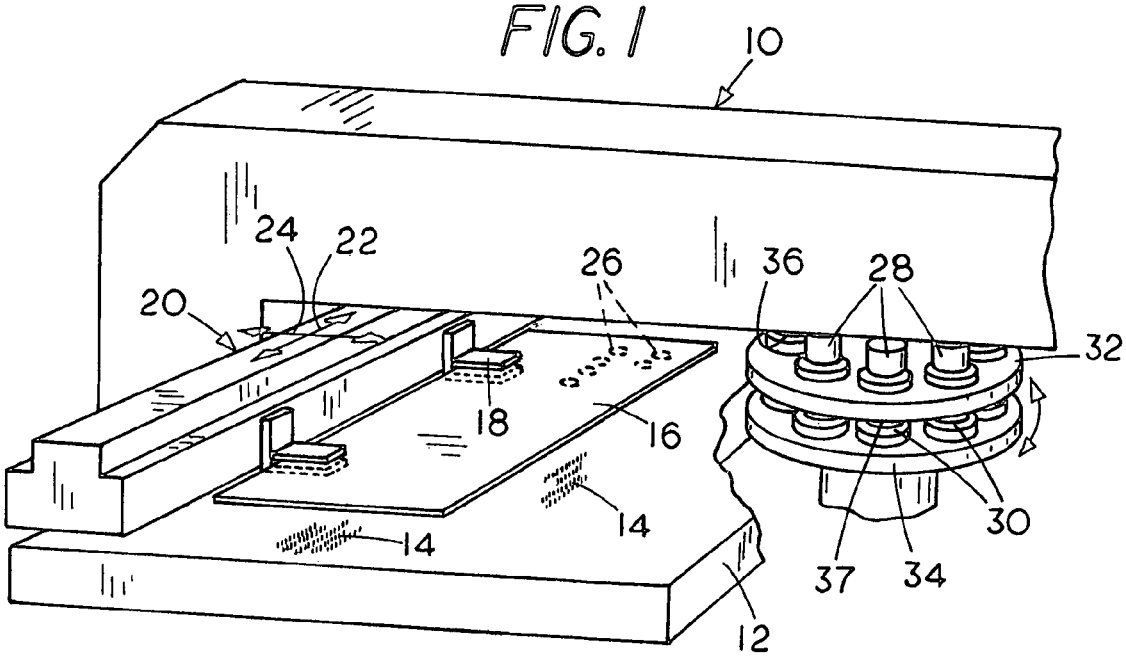
FIG. 1 is a perspective view of one form of punch press in which the invention can be used.

The invention can be employed in several different kinds of punch presses one of which is illustrated by way of example in FIG. 1. The punch press indicated generally by the numeral 10 includes a fixed base 12 that may be provided with vertically extending fibers 14 only a few of which are shown for supporting workpiece 16 that is securely held by a pair of clamps 18 which are in turn connected to a positioning rail 20 that is moved rapidly during operation to a series of programmed positions along horizontal x and y axes 22 and 24 under the automatic control of a computer (not shown) to punch a series of openings 26 in the workpiece 16 or otherwise form the workpiece each time the workpiece is brought into the proper position between a punch 28 and cooperating die 30. The punches 28 are distributed circumferentially on a circular punch turret 32 and the dies 30 in turn are each supported on a lower turret 34 in alignment below one of the punches. During operation, the turrets 32 and 34 are rotated together under control of the machine-operating computer to place the pre-selected punch and die sets sequentially in an operating position 36 where the punching operation is preformed to produce a pre-selected pattern of openings 26 in the workpiece 16. The punch press 10 as described hereinabove is of any suitable commercial available type and the invention can, of course, be used with any of a variety of punch presses, the construction and operation of which is well known to those skilled in the art.

Figure 7:
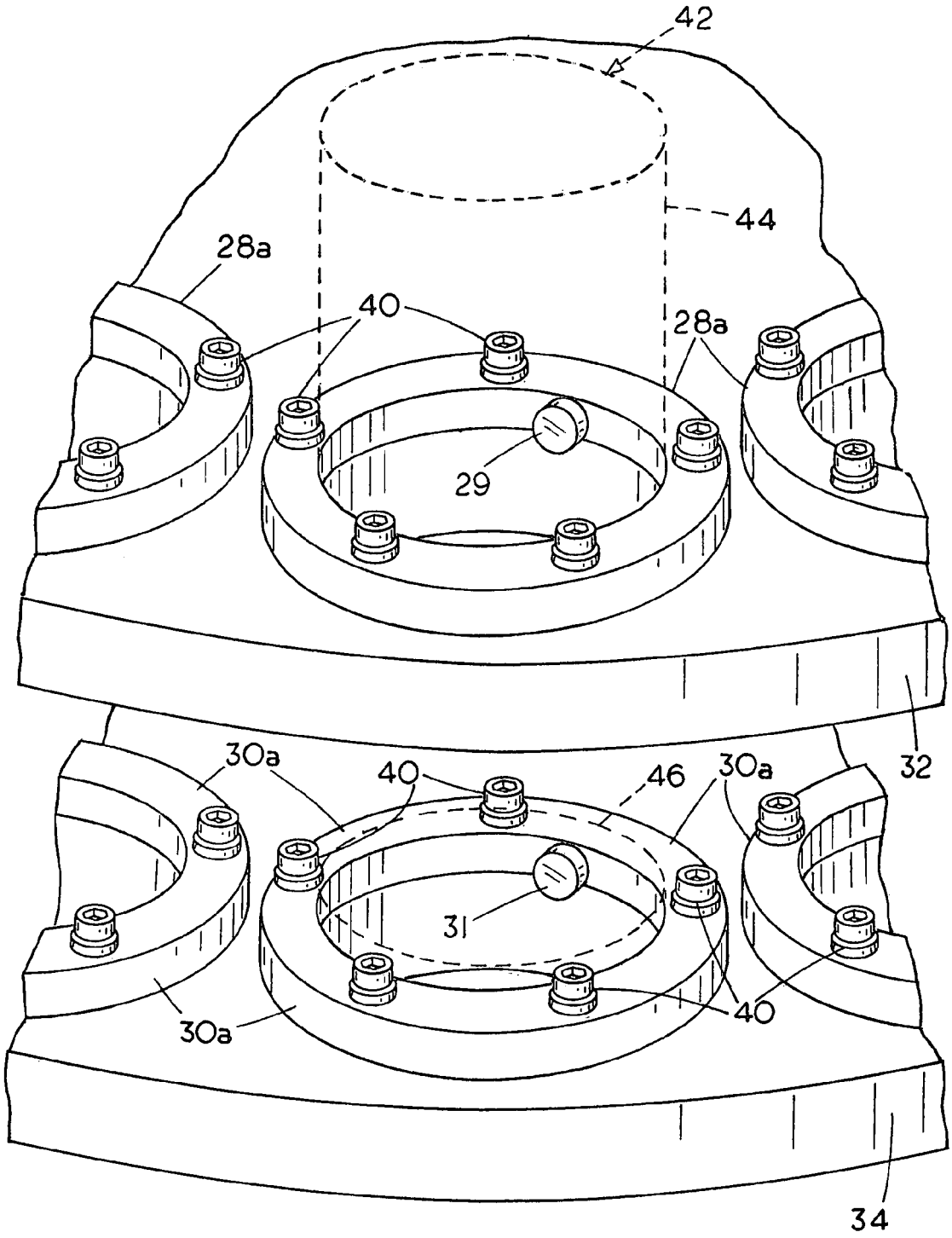
FIG. 7 is a partial perspective view of the punch press turret area showing the positions taken by the upper and lower components of the instrument just prior to aligning the tool holders.

As best shown in FIG. 7, punches 28 are held in a series of circumferentially arranged annular punch holders 28*a* and the dies are held in annular circumferentially arranged die holders 30*a*, each of which can be secured to its supporting turret once aligned with one another by means of fasteners in this case cap screws 40. To place upper and lower cooperating pairs of tool holders 28*a* and 30*a* in alignment with one another, the alignment instrument 42 of the present invention is set in the tool holders 28*a*, 30*a* and aligned, as will be described below, so as to thereby place each punch and die set into alignment with one another. The cap screws 40 can then be tighten to maintain the alignment once the alignment instrument 42 has been removed.

The alignment instrument will now be described with references to FIGS. 2-5. The alignment instrument 42 includes an upper component 44 and a lower component 46 each generally cylindrical in shape and having outer cylindrical alignment surfaces 48 and 50 respectively which fit within the tool holders 28*a* and 30*a* respectively during use. The upper component or part 44 includes a central chamber 52 within which is provided a battery pack 54, a control circuit 56 (FIG. 3) described more fully in connection with FIG. 11 and an indicator light 58 which projects through an opening in a removable sheet metal cover 60. The upper and lower components 44, 46 are provided with complementary mating surfaces comprising a pair of upwardly projecting downwardly opening slots 43 and 45 in the upper component 44 and two pair, i.e., four vertically disposed upwardly extending complementary teeth 43*a* and 45*a* that project upwardly from the top surface of the lower component 46*a* into the mating slots 43 and 45. It can be seen that the teeth 43*a* and 45*a* are in nonparallel (in this case perpendicular) relationship as are the cooperating slots 43 and 45. The teeth 43*a* and 45*a* are provided only on the outer annular portion 46*a* of the lower component 46 and the slots are similarly positioned to extend upwardly from the lower surface of the upper component 44 of the instrument.

Figure 3:
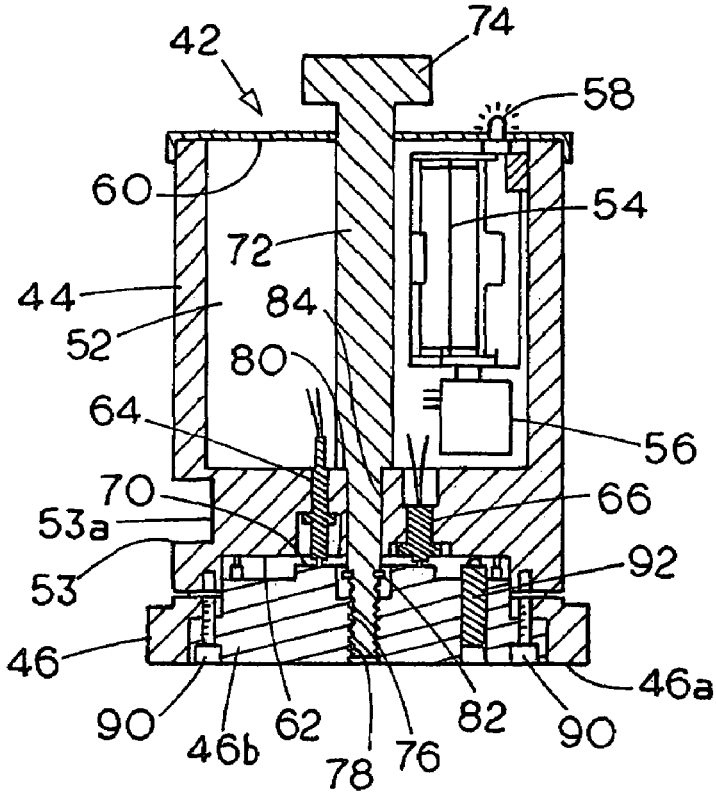
FIG. 3 is a vertical sectional view taken on line 3-3 of FIG. 2 with the upper and lower components in contact.
Figure 3A:
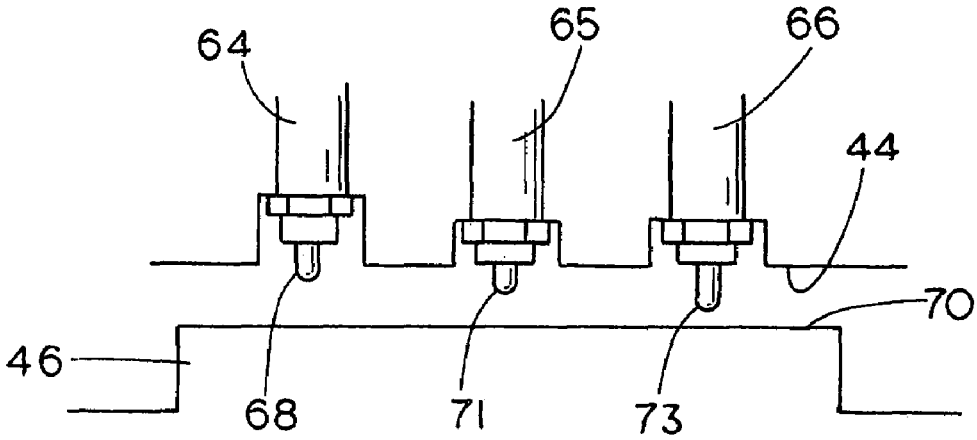
FIG. 3A is a greatly enlarged diagrammatic view showing tactile alignment switches on a larger scale.
Figure 4:
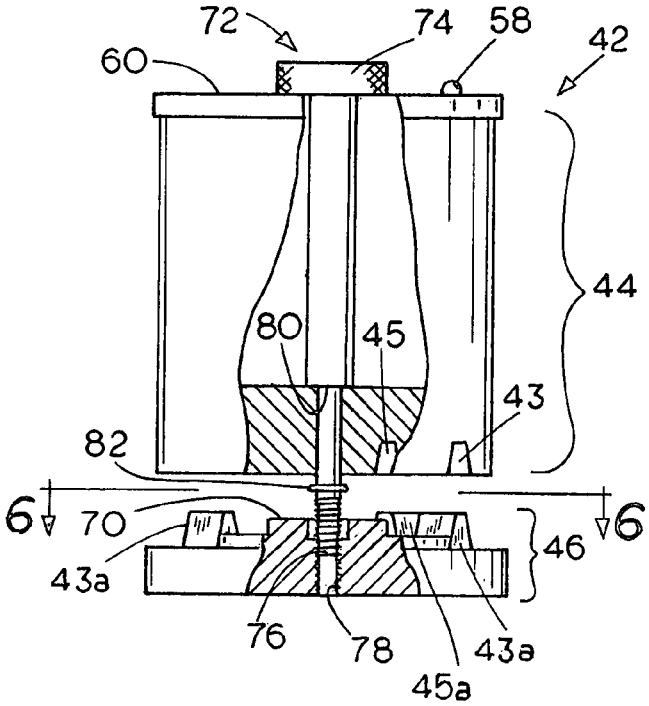
FIG. 4 is a side elevational view of FIG. 2 partly in section.

Extending downwardly through a bottom surface 62 component of 44 are a plurality (typically three) alignment indicators comprising contact sensing switches, two of which, 64 and 66, can be seen in FIG. 3. FIG. 3*a* shows how actuator buttons 68, 71 and 73 of all the switches 64, 65 and 66 are placed at different elevations so as to be actuated sequentially by contact with a flat horizontally disposed upper switch contact surface 70 of the lower component 46. Because the switch contact buttons 68, 71 and 73 are at different elevations, as the upper component 44 is lowered, switch 66 will be actuated first, then switch 65 and finally switch 64 will be actuated. To establish the correct zero point, each of the switches 64-66 is threaded into the upper component 44. The switch 64 is then threaded up or down until it turns on exactly when the upper and lower components 44 and 46 are aligned and in contact with one another. The other two switches 65 and 66 are then set to project different distances below switch 64 to indicate when the components are coming close to alignment.

The upper and lower components 44 and 46 of the instrument 42 are brought toward one another during operation by means of a control member consisting of a screw 72 having an operating knob 74 that is turned manually and a threaded section 76 at its lower end that is screw threaded into a vertical threaded bore 78 in the lower component 46. The screw 72 is provided with a shoulder 80 that bears against the bottom wall of the chamber 52. A snap ring 82 on screw 72 keeps the screw within a bored opening 84 (FIG. 3) at the center of the upper component 44. The lower component 46 consists of an annular outer portion 46*a* and a central disc 46*b* which is secured to 46*a* by fasteners such as screws 90 (FIG. 3). Optionally provided on the lower component 46 are plurality, in this case three spaced apart spring loaded plungers 92 each having an upwardly projecting downwardly compressible spring loaded plunger element 94 that exerts an upward force on part 44 as parts 44 and 46 are brought together. The spring loaded plunger 94 functions as lifting units to raise the upper component 44 from the lower component 46. The travel of the plungers is great enough to lift the upper component 44 a sufficient distance to compensate for rotational inaccuracies of the upper turret with respect to the lower turret when the turrets are rotated into the loading position, i.e., when not in the active position shown at 36 in FIG. 1. Alternatively, a spring can be placed between clip 82 and component 44.

Component 44 includes a vertical longitudinally extending outwardly opening alignment slot 49 on its outer surface 48 that during operation is engaged on a positioning lug 29 which extends centrally from an inside surface of the punch holder 28*a*. Similarly, the lower component 46 is provided with a vertical outwardly opening slot 51 which is engaged during use over a centrally extending alignment lug 31 that projects centrally from die holder 38. The lug 29 thus provides a zero reference point to establish the correct rotational position of the punch holder 28*a*. The positions of the upper and lower components 44 and 46 just prior to alignment are indicated by dashed lines in FIG. 7. The upper component 44 is also provided with a horizontally extending outwardly opening slot 53 with a vertically disposed inner surface 53*a* (FIG. 8).

Figure 8:
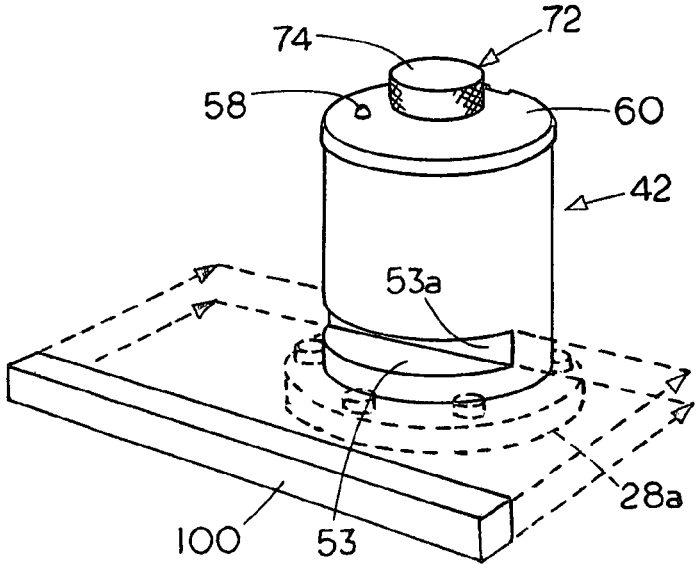
FIG. 8 shows how an alignment bar is placed in contact with the alignment instrument.
Figure 9:
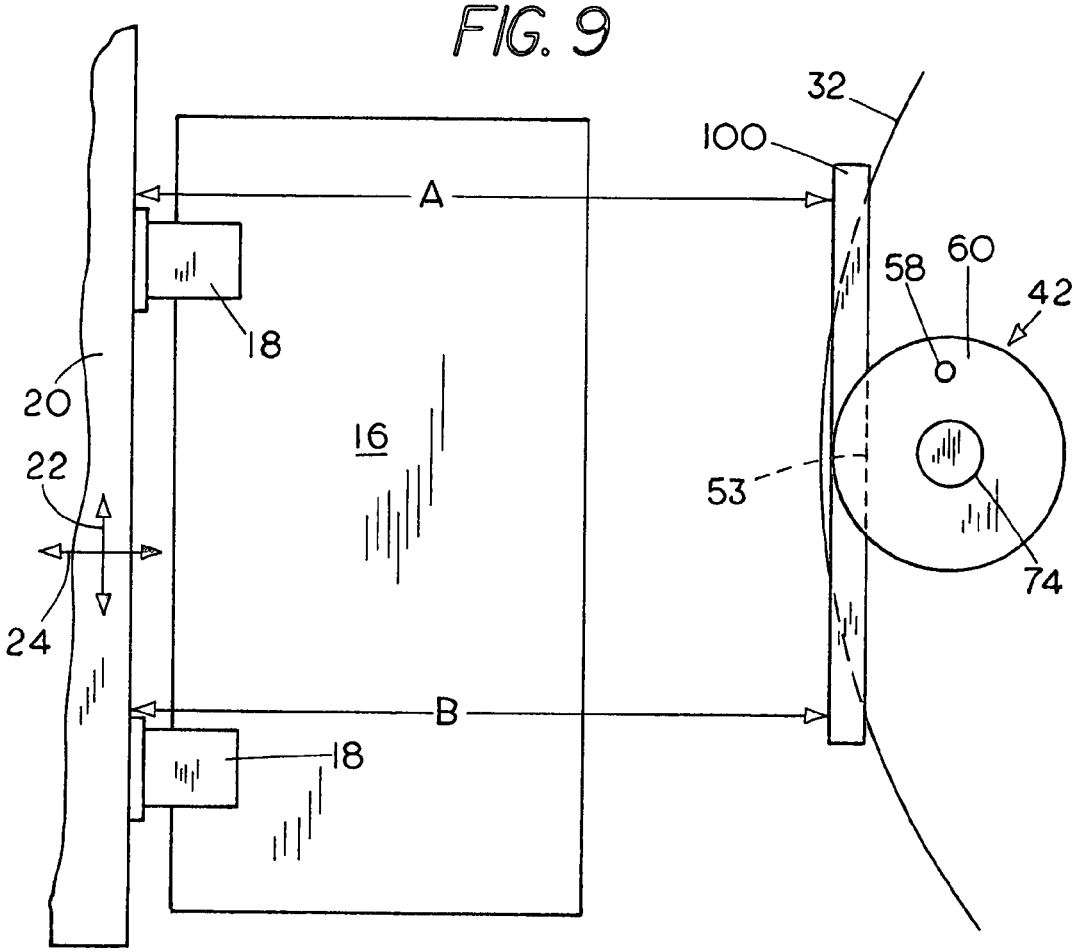
FIG. 9 is a diagrammatic plan view showing how the instrument is aligned about a vertical axis with respect to the punch press base.

Refer now to FIGS. 8 and 9. When the upper portion 44 the instrument is to be aligned with the positioning rail 20, an alignment bar 100 is placed manually in the slot 53 and is held firmly against the inner surface 53*a*. The bar 100 is then aligned with positioning rail 20, e.g., by making measurements at (A) and (B) until (A) and (B) are equal. The dimensions (A) and (B) can be measured using an ordinary linear scale, a dial indicator or by means of a suitable optical distance measuring system. Once (A) and (B) are measured and found to be equal, the punch holder 28*a* is properly aligned about a vertical axis 6. The caps screws 40 holding the upper tool holders 28*a* in place can then be tightened to securely lock the upper component 44 of the instrument in place on the upper turret 32. With the lower caps screws loose, the lower component 46 of the instrument is placed in the die holder 30*a* with the lug 31 in slot 51. The alignment control screw 72 is then turned downwardly by hand using the knob 74 so that the threads 76 at its lower end draw the upper component 44 downwardly into contact with the lower component 46.

Figure 10:
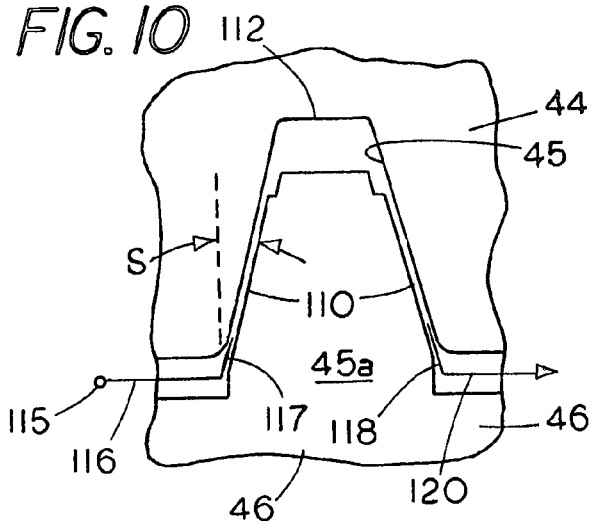
FIG. 10 is a greatly enlarged side elevational view taken on line 10-10 of FIG. 5.

Refer now to FIG. 10 which shows how each of the teeth 43*a*, 45*a* are tapered by providing tapered side walls 110 that converge toward one another proceeding toward its upper surface 112 so that each of the teeth is wider at its base. It was found suitable to taper each of the sidewalls at an angle S which can be about 15° to the vertical as shown in FIG. 10.

Figure 2:
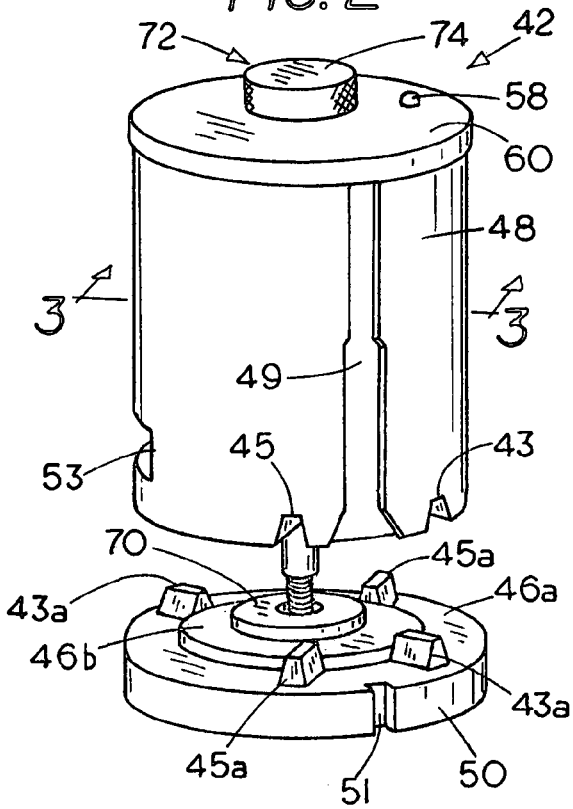
FIG. 2 is a perspective view of the alignment instrument with the upper and lower components spaced apart from one another for clarity of illustration.

It will be noted that when the upper and lower components 44 and 46 approach one another as shown in FIGS. 2 and 10, the tapered walls of the teeth 45*a* as well as teeth 43*a* will gradually be brought into contact with the slots 43 and 45. Since the teeth 43*a* are not aligned with teeth 45*a* (in this case are at right angles thereto) the upper and lower components will be brought into coaxial alignment on horizontal x and y axes simultaneously. At the same time, the engagement between the sidewalls 110 of the teeth with the corresponding inner walls of the slots 43 and 45 will rotate the lower component 46 slightly bringing it into perfect rotational alignment with the upper component 44 about a common vertical axis that is orthogonal to the x and y axes. Thus, alignment is achieved between the upper and lower components 44 and 46 simultaneously on two mutually perpendicular horizontal axes while angular alignment is achieved about a common vertical axis.

Figure 6:
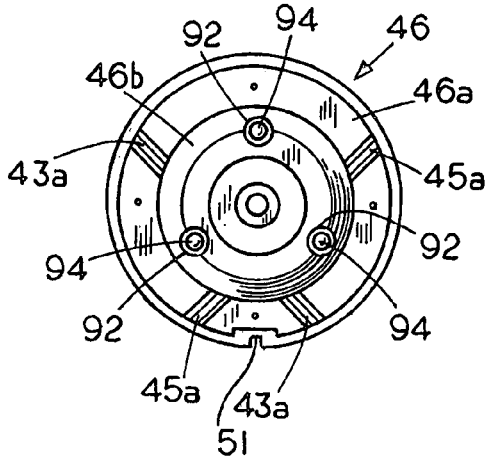
FIG. 6 is a horizontal sectional view taken on line 6-6 of FIG. 4 on a slightly smaller scale.
Figure 5:
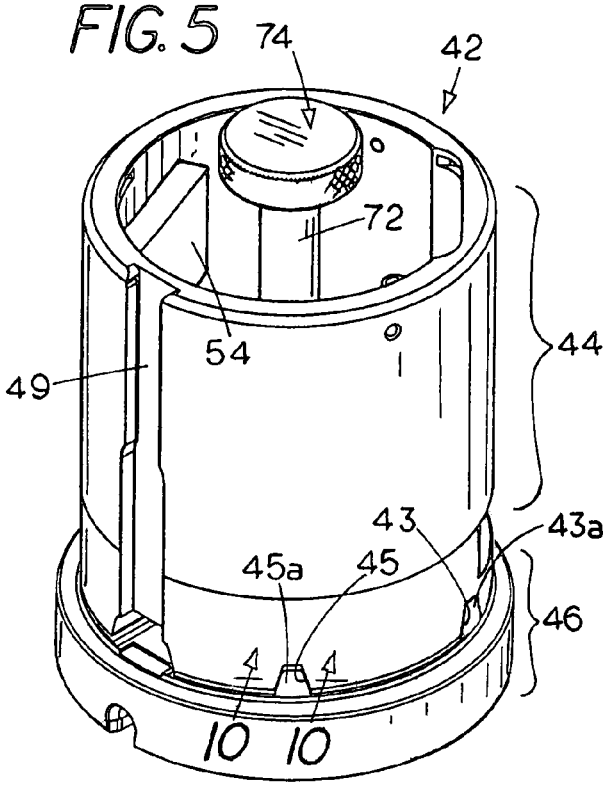
FIG. 5 is a perspective view of the invention with the cover removed.

The instrument can be manufactured in various ways, but it has been found highly advantageous first to machine the sidewalls 48 and 50 of the instrument 42 including both the upper component 44 and the lower component 46 while part of a single cylinder of steel and to grind the outer surfaces 48 and 50 concentric with one another to form the tool holder engaging surfaces and thereafter sever the upper component 44 from the lower component 46 by electrical wire discharged machining (EDM). Alternatively, the components 44 and 46 can be securely reconnected after being severed and then finished on their outer surfaces. In EDM machining, a high voltage electrical potential is established between the part being machine and an electrical discharge wire that is held under tension. To simplify machining, the teeth and the slots are each positioned somewhat laterally of center as shown in FIGS. 2 and 6. For example, in separating the parts 44, 46 in FIG. 10 an electrical discharge wire 115 shown in end view is first moved laterally at 116, then upwardly at a 15° angle as shown at 117, laterally across the top of the teeth 45*a* toward the right, downwardly on a 15° incline, horizontally at 120 until the parts are separated. The surfaces of the teeth and slots, i.e., ridges and grooves, can be left unpolished or if desired can be polished by hand with an abrasive surface such as an Arkansas stone. EDM has been found highly effective in maintaining alignment between the upper 44 and lower 46 components of the instrument 42. The concentric machining of the surfaces 48 and 50 while the instrument is in one piece or subsequent to splitting it will assure concentricity and hence proper alignment of the tool holders after the components 44 and 46 have been separated. Other precise machining methods can be used in place of EDM if desired.

Figure 11:
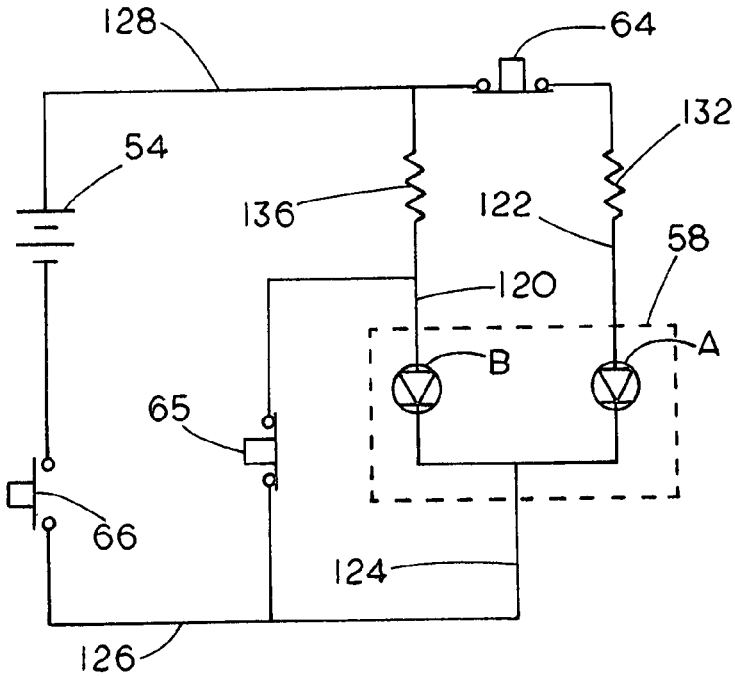
FIG. 11 is a circuit diagram for the indicator.

Refer now to FIG. 11 which shows the circuit diagram for the indicator light 58. In this case the indicator light 58 is a three lead tri-color light emitting diode (LED) having a green diode component (A) and red component (B) which are connected in parallel so that the light or diode module 58 has three leads 120, 122 and 124 which are wired across the battery 54 (two AA cells) by conductors 126 and 128. Wired in series with the diodes are two dropping resisters 130 and 132 that are connected in parallel through the normally closed switch 64 to the battery 54 via conductor 128. The resistors can be 47-ohm ¼ watt resistors. Wired between the resistor 136 and the diode (B) is the normally closed switch 65. In series with the battery 54 is a normally open switch 66. While any suitable switches can be used, tactile switches such as DB 5 series switches by Omron Corporation of Schaumberg, Ill. can be used. The LED 58 can be a model LTL-30EHJ unit by Light-On Electronics, Inc.

In operation, as the knob 74 of the control 72 is turned bringing the upper and lower components 44 and 46 closer together, the switch 66 is closed first through engagement with the switching surface 70 which turns on diode (A) to produce a red light. Next, as the upper and lower components 44, 46 are brought into even better alignment, the switch 65 is opened thereby turning on the diode (B) so as to produce a yellow light through a combination of (A) and (B). Finally, when the upper and lower components 44 and 46 are in perfect alignment, the switch 64 is opened so as to turn off the current to the diode (A) leaving only (B) a green light which indicates that the components 44 and 46 of the instrument 42 and the tool holders 28*a* and 30*a* which are in contact with them are in alignment with each other. The caps screws 40 that hold the punch holder 28*a* have already been tightened or can now be tightened to lock the punch holder 28*a* in place on the turret 32. Cap screws 40 that hold the die holder 30*a* can now be tightened to secure the die holder 30*a* in place on the turret 34. The alignment of the punch and die is now assured. The instrument is then removed from the punch and die holders 28*a*, 30*a*. This process is continued until all the cooperating pairs of punch and die holders have been locked in alignment on the turrets 32 and 34. The punch and die sets can then be placed in the holders with assurance that they are in alignment. The punch press 10 is then operated conventionally.

While the alignment sensors 54-56 in the example given are contact sensing switches, the alignment of tool holders as determined by the spacing between the upper and lower components 44 and 46 can be sensed in other ways, e.g., optically, magnetically, by ultrasonic sensing or even with a feeler gauge to thereby indicate the degree of alignment or misalignment between the upper and lower components 44 and 46. Alignment can be indicated either visually as already described or audibly, e.g., by means of a sound-producing device to provide a tone or series of beeps.

Figure 12:
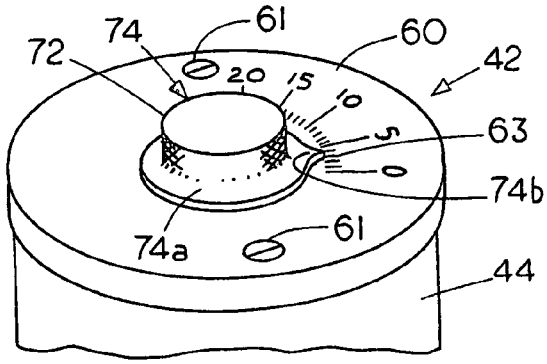
FIG. 12 is another form of an alignment indicator.

Refer now to FIG. 12 which illustrates another embodiment of the invention that employs a different kind of alignment indicator. In this case, the knob 74 at the top of the control 72 has rigidly connected to its lower edge a thin metal flange 74*a* with pointer 74*b*. The top of the cover 60 which in this case is rigidly fastened to the top of the upper component 44 by screws or other fasteners 61 is provided with a circular scale 63 which comprises printed indicia or other markings to indicate the spacing between the upper and lower components of the instrument 42. When the pointer 74*b* reaches zero on the scale the upper and lower components are aligned. The knob 74 includes a force-limiting clutch like that commonly used in a micrometer which is adapted to release upon reaching a predetermined torque limit to reduce and preferably eliminate distortion of the apparatus, e.g., the screw 72 or switches 64-66 or the surface 70.

The invention has proved to be highly successful by providing a dimensional precision that has been improved to the point where alignment devices previously available are not good enough to match tolerances that can be achieved with the invention.

In addition, the present invention provides inherent precision while at the same time having a low manufacturing cost, ease of obtaining accurate alignment of undisputed quality and simplicity of operation.

Refer now to FIGS. 13-16 wherein the same numerals refer to corresponding parts already described above to illustrate a feature of the invention for allowing the upper and lower components 44 and 46 of the alignment instrument to be placed in contact with one another only when they are in a position capable of being aligned. This provision has been developed because many commercial punch press are constructed so that the upper turret 32 does not rotate on the same axis as the lower turret 34. Consequently, the punch and die holders are far out of alignment at certain times. The punch and die holders may be out of alignment under certain circumstances for other reasons. It is therefore important for the operator to be able to control at what point the upper component 44 can be lowered into engagement with the lower component 46. If this were not done, the instrument could be damaged when the turrets were rotated. Thus the device illustrated in FIGS. 13-16 provides a feature to prevent premature or undesired contact between the upper and lower components 44 and 46 respectively especially when their axes are either far out of alignment or could become misaligned, an event that could damage the instrument.

Figure 13:
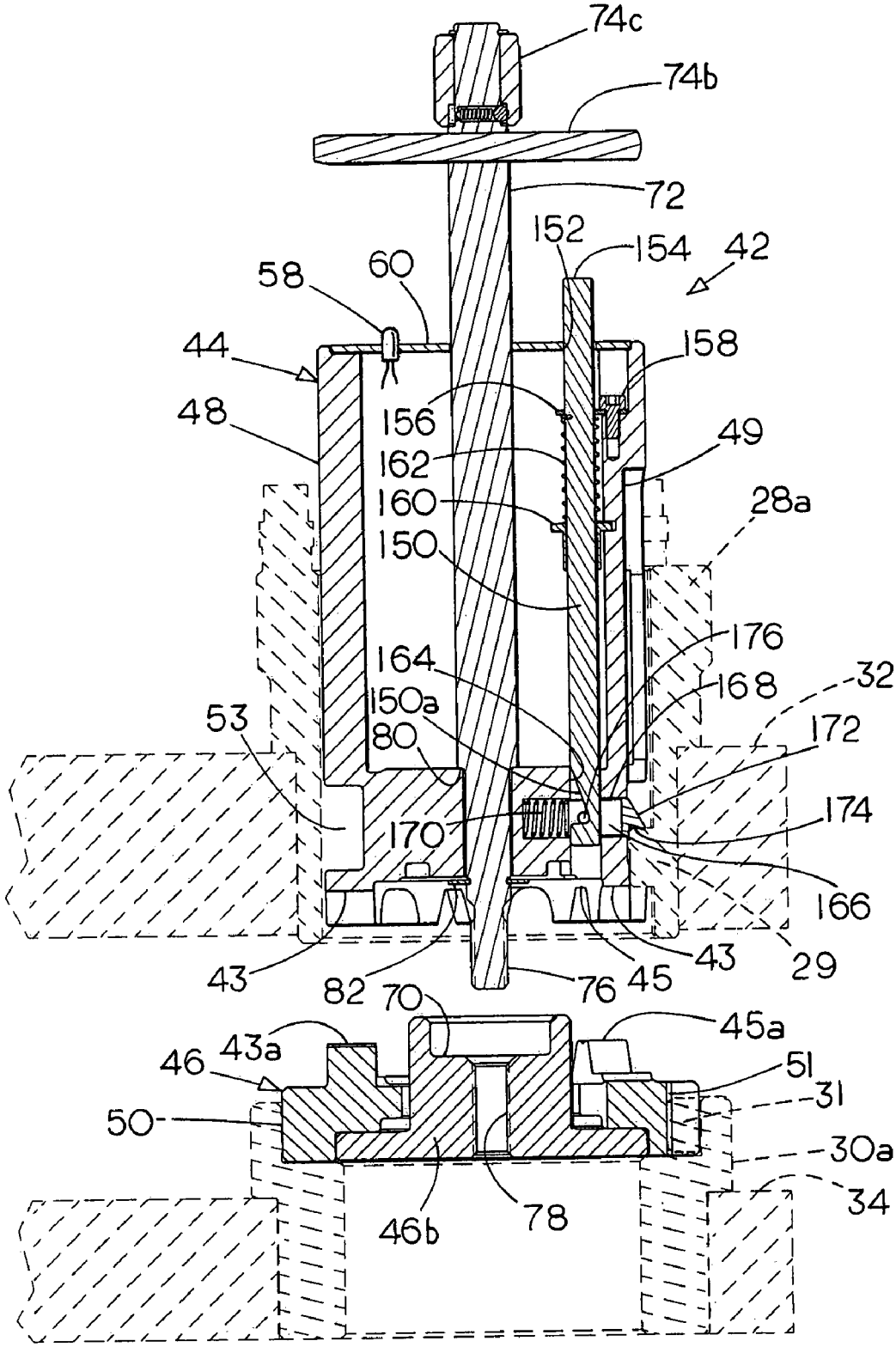
FIG. 13 is a vertical sectional view similar to FIG. 4 to illustrate a means for controlling engagement between the upper and lower components of the instrument which shows the upper component held in a raised position.

In the embodiment shown in FIGS. 13-16, the control member 72 is provided with a T-bar 74*b* at its upper end which consists of a metal bar passing through the control member 72. Just above bar 74*b* is a tensioning knob 74*c*. To one side of the control number 72 is a vertically disposed release rod 150 having an upper end that extends through an opening 152 in the cover 60 and terminates slightly above the cover to serve as a release button 154. The release rod 150 is slideably mounted within the instrument for movement on a vertical axis within a vertical bore 164 near the lower end of the upper component 44. The upper part of the release rod is supported for sliding movement through an opening in a retaining clip 156 secured by a screw 158 and by a sleeve 160 that extends into the sidewall of the instrument as seen at the right in the FIG. 13. Between the retaining clip 156 and the sleeve 160 is a helical compression spring 162 to yeildably bias the release rod 150 upwardly to the position shown in FIG. 13. The lower end of the release rod extends through an opening 166 in a retaining element or pawl 168. The pawl 168 is mounted for horizontal sliding movement within a bore at the lower end of instrument component 44 and is yeildably biased outwardly by a compression spring 170 to assume a position shown in FIG. 13. The free end of the pawl 168 is provided with an inclined surface 172, the upper end of which is slanted toward the center of the instrument. The free end is also provided with the downwardly facing horizontal support surface 174 that can assume the position shown in FIG. 13 resting on the upper surface of the lug 29. Mounted within the pawl 168 is a horizontally disposed locating pin 176 that is positioned within a recess in the release rod having a slanted ramp surface 150*a*. When the pawl 168 is extended as shown in FIG. 13, the part 174 resting on the lug 29 will support the upper instrument component 44 in the turret 32 thereby preventing a premature or undesired lowering of the upper part of the instrument for example when it is not aligned or fairly close to alignment with the lower component 46.

Figure 14:
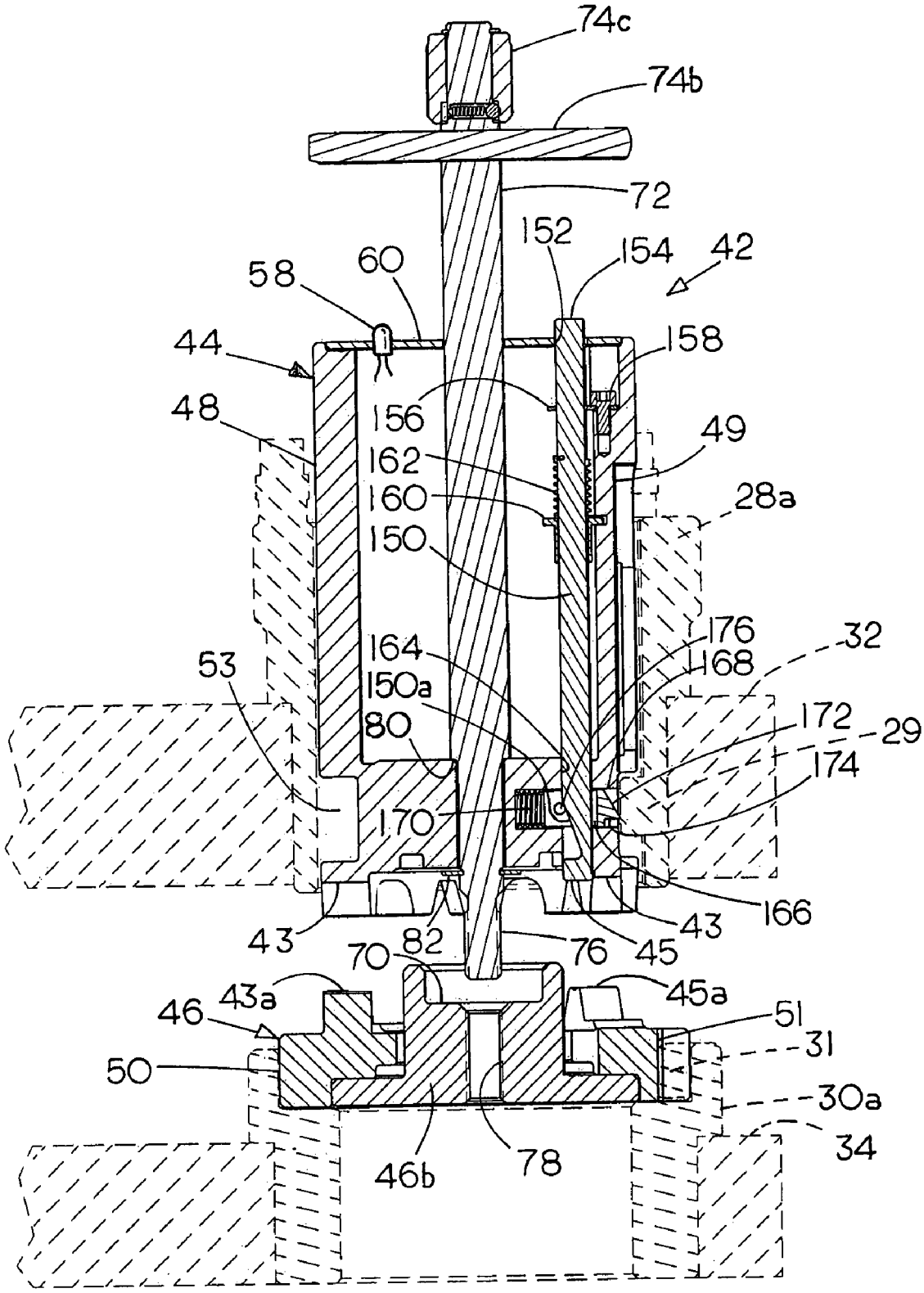
FIG. 14 is a view similar to FIG. 13 showing the upper component lowered slightly.

Referring now to FIG. 14, it will be seen that the manually operable release rod 150 has been pressed against spring 162 so that the ramp 150*a* by engaging the pin 176, retracts the retaining element or pawl 168 to a releasing or inactive position allowing the upper instrument component 44 to be lowered past the lug 29.

Figure 15:
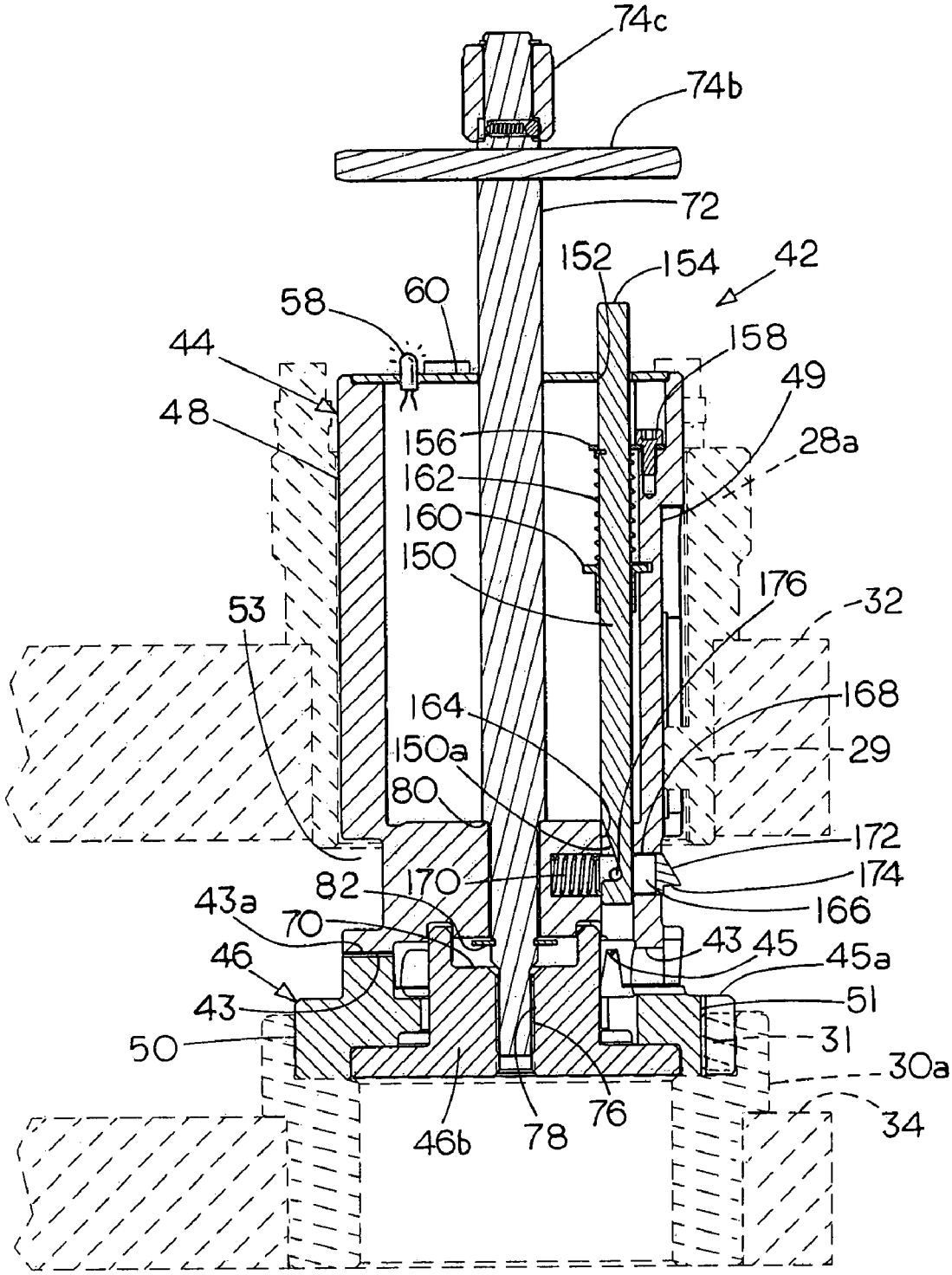
FIG. 15 is a view similar to FIGS. 13 & 14 showing the upper component fully lowered and in contact with the lower component.

FIG. 15 shows how the upper component 44 engages the lower component 46 for conducting the alignment or the alignment verification function when the components are in a position such as the punching station where they can be placed in alignment. It will also be noticed that a retaining element 168 has again been extended to the operative position by the spring 170.

Figure 16:
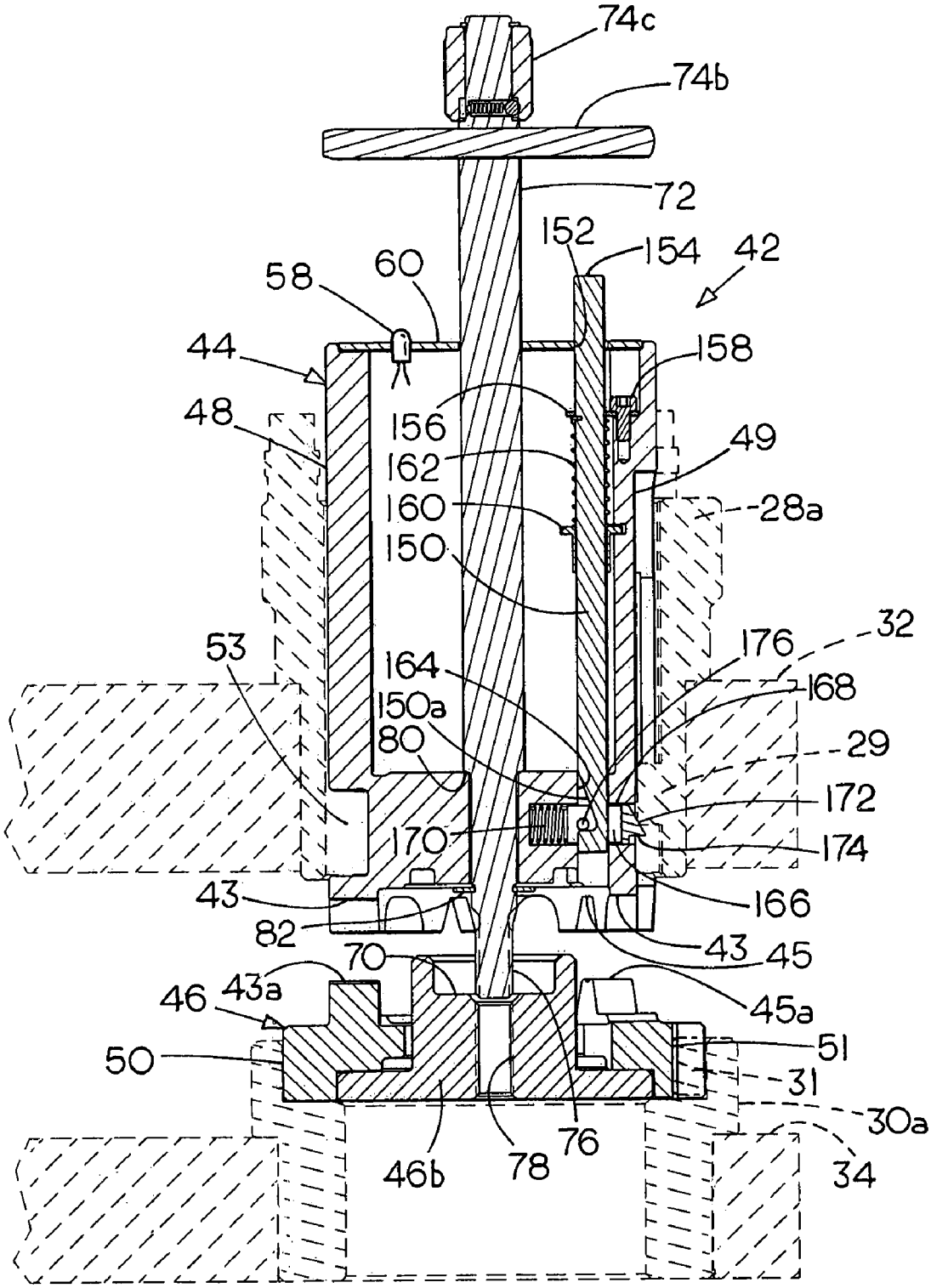
FIG. 16 is a view similar to FIGS. 13-15 showing a locking pawl partially pushed in as the upper component is being raised by the operator.

FIG. 16 shows how the upper instrument component 44 can be lifted upwardly by grasping the T-bar 74*b* or removed completely from the upper tool holder 28*a* and as this is done, retaining element 168 will be forced to a retracted position due to the engagement between the lug 29 and inclined surface 172 on the free end of the retaining element 168 allowing the element 168 to pass the lug 29 as the upper instrument component 44 is removed after the alignment or the alignment verification function has been performed. The lower component can then be removed.

It can be seen that the upper and lower components 44 and 46 of the instrument respectively have portions such as the sockets 43 and teeth 43*a* and 45*a* for aligning the tool holders of the punch press when in contact. The pawl 168 functions as a releasable supporting element that is operatively associated with the instrument 42 for temporarily holding the instrument components 44 and 46 out of contact with one another until released at the punching station 36 (FIG. 1) to prevent premature contact when the upper and lower components 44, 46 are for some reason out of vertical alignment with one another. From the above description, it can also be seen that the pawl 168 is selectively positionable so that when extended as shown in FIG. 13 or frictionally engaged with the turret or some part of the turret such as the tool holder 28*a*, it will hold the upper and lower parts of the instrument apart from one another until released.

During use, the upper component 44 of the instrument is placed in the tool holder 28*a* with the pawl 168 extended as shown in FIG. 13. However, when the instrument is located where the components 44 and 46 of the instrument can be aligned (e.g. at the punching station 36 shown in FIG. 1), the pawl can be manually retracted by pressing on the release button 154 at the upper end of the release rod 150 so that the ramp surface 158 engaging pin 176 retracts the pawl 168 against the compression spring 170 to thereby transfer the pawl to an instrument-releasing position for allowing the components of the instruments 42 to move toward one another and into engagement. Thus, as the button 154 is pressed and the release rod 150 is lowered, the ramp 150*a* engaging pin 176 will render the supporting element 168 inactive, thereby allowing the instrument components to move into contact with one another for aligning the tool holders 28*a* and 30*a* of the punch press.

When the retaining element, in this case pawl 168 is extended as shown in FIG. 13, it enables the upper and lower components 44 and 46 to be moved laterally either toward or away from an aligned position for an example as the turrets 32 and 34 rotate on different centers. However, when they come into alignment at the punching station, pressing button 154 downwardly retracts the retaining element or pawl 168 allowing the upper instrument component 44 to descend toward the lower one for carrying out the alignment or alignment verification function.

The following instructions can be used for operating the instrument.

Verification Mode

1. Rotate the press turret until the station to be verified is in the tool change position and remove punch guide and/or die from the die holder.
2. Install the lower calibration instrument into the die holder and tighten the clamp screw(s) as you would for a die.
3. Install the upper calibration instrument into upper holder then, gently lower the instrument until the locking pawl 168 rests on the top of the turret lug in the machine. Caution: Do not allow the upper instrument to drop onto the turret lug or through the turret bore as this may damage the instrument and/or the turret bore.
4. Look into the turret gap to ensure the threaded end of the control member 72 is not engaged with the lower calibration instrument.
5. Rotate the turret until the station to be verified is positioned under the press ram. Note: The turret must be locked in place. For auto-index stations, the auto-index must be engaged.
6. Lower the upper instrument gently, by depressing the release button and lowering the upper instrument component 44 using the T-bar control member, until its threaded end rests on the top of the lower instrument. Caution: Do not allow the upper instrument component to drop onto the turret lug or through the turret bore as this may damage the instrument and/or the turret bore.
7. Reach into the machine and rotate the tensioning knob 74*c* of control member 72 until the interlocking teeth of the upper and lower instruments are fully engaged and the tensioning knob 74*c* starts to click. Do not use the T-bar, as this may result in a false verification.
8. View the color of the indicator light. If the light is obscured, then view the reflection of the light on the handle Red: angularity and concentricity is not confirmed. Perform as described below.

Yellow: angularity and concentricity is within 0.0012(0.30)

Green: angularity and concentricity is within 0.0003 (0.008)—ideal for 0.048(1.20) material or less.

9. Loosen the control member 72 until its threaded end is fully disengaged from the lower instrument.
10. Lift the upper instrument gently, using the length of member 72, until the lock pawl rests on the top surface of the turret lug.
11. Look into turret gap to ensure the threaded end of member 72 is not engaged with the lower instrument.
12. Rotate the turret until the station that has been verified is in the tool change position.
13. Note: If you did not previously use the alignment mode, then skip this step. Tighten any screws that were previously loosened during alignment in accordance to the punch press manufacturer's torque specifications.
14. Repeat steps 5 to 11 above to ensure the tool holder did not move during tightening.
15. Remove the upper and lower instruments.

ALIGNMENT MODE—For thick turret punch press with fixed upper holder and moveable lower holder.

Install the Instruments into the Punch Press

1. Rotate the turret until the station to be aligned is in the tool change position, and remove punch holder and/or die as applicable. (Tip: Tooling in adjacent stations should also re removed to provide an adequate work space.)
2. Inspect the upper turret bore for damage. Pay particular attention to the turret bore keys. The upper calibration instrument should slide freely in the upper turret bore. Repair as required, prior to alignment.
3. Loosen the screw(s) that hold die holder in place. (Tip: Any thread-retaining compound used in previous installations should be removed).
4. Tighten the screw(s) mentioned above until just snug. The die holder will need to slide during the alignment process.
5. Install the lower calibration instrument 46 into the die holder and tighten the clamp screw(s) as you would for a die.
6. Install the upper calibration instrument component 44 into upper holder, gently lowering the instrument until the lock pawl 168 rests on the top of the turret lug in the turret bore. Caution: Do not allow the upper instrument to drop onto the turret lug or through the turret at this may damage the instrument and/or the turret bore.
7. Look into the turret gap to ensure the threaded end control member 72 is not engaged with the lower calibration instrument.

Align Lower Holder

1. Rotate the turret until the station to be aligned is at the punching station under the ram. Note: The turret must be locked in place. For auto-index stations, the auto-index must be engaged.
2. Lower the upper instrument component 44 gently by depressing the release button 154 and lowering the instrument using the T-bar of control member 72 until its threaded end rests on the top of the lower instrument. Caution: Do not allow the upper instrument to drop through the turret bore as this may damage the instrument and/or the turret bore.
3. Reach into the machine and tighten the control 72, using the T-bar 74*b*, until the interlocking teeth 43-45 and 43*a*-45*a* of the upper and lower instruments are fully engaged. The indicator light will change color from red, to yellow, and then to green. During this process the lower tool holder will be adjusted into precise concentric and angular alignment with the upper tool holder. Caution: Do not use any device other than the T-bar to tighten the control member 72. Excessive torque may damage the machine and/or the calibration instrument.
4. Loosen the control member 72 until its threaded end is fully disengaged from the lower instrument.
5. Lift the upper instrument component 44 gently, using the T-bar, until the lock pawl rests on the top surface of the turret lug.
6. Look into turret gap to ensure the threaded end of the control 74 is not engaged with the lower calibration instrument.
7. Rotate the turret until the station that has been aligned is in the tool change position. Caution: Do not rotate the turret with the two halves of the calibration instrument tightened together.
8. Tighten the die holder retaining screws until snug.
9. Proceed to step 5 of the Verification Mode Procedure on the previous page.

Many variations in the present invention within the scope of the appended claims will be apparent to those skilled in the art once the principles described herein are read and understood.

What is claimed is:

1. A punch press alignment instrument comprising, an upper body component for being mounted in an upper turret of a punch press, a lower body component for being mounted in a lower turret of a punch press below the upper component, the upper and lower components of the instrument are adapted to be moved to engage one another during use, said upper and lower components of the instrument having portions thereof for aligning tool holders of the punch press and a releasable supporting element operatively associated with the instrument for temporarily holding said upper and lower instrument components out of contact with one another until released to prevent premature engagement therebetween, such that release of the support element allows the upper and lower components to move toward one another and into engagement.

2. The instrument of claim 1 wherein the releasable supporting element is a selectively positionable member that is associated with the punch press for holding the upper and lower components apart from one another until released.

3. The instrument of claim 2 wherein the selectably positionable member is movably mounted on the instrument for being retracted manually to an instrument-releasing position for allowing said upper and lower components of the instrument to move toward one another.

4. The instrument of claim 1 including a manually movable member associated with the supporting element for rendering the supporting element inoperative to thereby allow said instrument components to move into contact with one another for aligning tool holders of the punch press.

5. The instrument of claim 4 wherein the supporting element is a pawl and the moveable member is a release member operatively associated with the pawl for retracting the pawl to an instrument-releasing position when the release member is activated.

6. A punch press alignment instrument comprising, an upper body component for being mounted in an upper turret of a punch press, a lower body component for being mounted in a lower turret of a punch press below the upper component, the upper and lower components of the instrument are adapted to be moved relative to one another during use, said upper and lower components of the instrument having portions for aligning tool holders of the punch press and a retaining element on the instrument that is operatively related to the punch press for holding one of the instrument components in a position that allows the instrument components to be moved laterally relative to one another either toward or away from alignment with one another and to be moved into engagement with one another when located at a punching station of the punch press.

7. The instrument of claim 6 wherein the retaining element is a selectively positionable member that is adapted to engage the punch press for holding the upper and lower components apart from one another until released.

8. The instrument of claim 7 wherein the selectably positionable member is movably mounted on the instrument for being refracted manually to an instrument-releasing position for allowing said upper and lower components of the instrument to move toward one another.

9. The instrument of claim 6 including a manually movable operating member associated with the retaining element for rendering the retaining element inactive to thereby enable said instrument components to move into contact with one another for aligning tool holders of the punch press.

10. The instrument of claim 9 wherein the retaining element is a pawl and the operating member is a moveable release member operatively associated with the pawl for retracting the pawl to an instrument-releasing position when the release member is moved by an operator.

11. The instrument of claim 6 wherein the retaining element extends radially from an upper instrument component and is retractable thereon such that the retaining element is able to either catch against a portion a turret of the punch press or a tool holder thereof and can be refracted to an inoperative position whereby the upper instrument component can descend to the lower instrument component for an alignment function or an alignment verification function.

12. The instrument of claim 6 including at least one such retaining element that comprises a radially extending retractable element adapted to project laterally from the instrument component or to be refracted therewithin.

13. The instrument of claim 6 wherein the retaining element is a friction element for frictionally engaging the punch press to support the instrument component.

14. The instrument of claim 6 wherein the retaining element is yieldable biased to a position for supporting the upper instrument component on the punch press.

15. The instrument of claim 6 wherein the retaining element is a radially extending element that is operatively bistable for alternate retraction or extension.

16. The instrument of claim 6 wherein the retaining element is retractable momentarily and elastically returnable to a locking position for supporting the upper component.

17. The instrument of claim 6 wherein the retaining element is a bi-stable pawl mounted for being alternately retracted to an inoperative position or extended to a position for supporting the upper instrument component on the punch press.

* * * * *

UNITED STATES PATENT AND TRADEMARK OFFICE

CERTIFICATE OF CORRECTION

PATENT NO. : 7,484,312 B2
APPLICATION NO. : 11/728685
DATED : February 3, 2009
INVENTOR(S) : Christopher D. Morgan It is certified that error appears in the above-identified patent and that said Letters Patent is hereby corrected as shown below:

Claim 8, column 12, line 10, change “refracted” to -- retracted --.

Claim 11, column 12, line 27, change “refracted” to -- retracted --.

Claim 12, column 12, line 34, change “refracted” to -- retracted --.

Signed and Sealed this

Twenty-fourth Day of March, 2009

JOHN DOLL
*Acting Director of the United States Patent and Trademark Office*